US006669579B2

(12) United States Patent
Kosmatka

(10) Patent No.: US 6,669,579 B2
(45) Date of Patent: Dec. 30, 2003

(54) GOLF CLUB HEAD HAVING A STRIKING FACE WITH IMPROVED IMPACT EFFICIENCY

(75) Inventor: John B. Kosmatka, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 44 days.

(21) Appl. No.: 10/065,690

(22) Filed: Nov. 8, 2002

(65) Prior Publication Data

US 2003/0190974 A1 Oct. 9, 2003

Related U.S. Application Data

(63) Continuation of application No. 09/683,799, filed on Feb. 15, 2002, now Pat. No. 6,478,692, which is a continuation-in-part of application No. 09/525,216, filed on Mar. 14, 2000, now Pat. No. 6,348,015.

(51) Int. Cl.[7] ..... A63B 53/04

(52) U.S. Cl. ..... 473/342; 473/329; 473/345; 473/349; 473/350

(58) Field of Search ..... 473/324, 332, 473/349, 350, 329, 342, 345, 346, 290, 291

(56) References Cited

U.S. PATENT DOCUMENTS

| | | | | |
|---|---|---|---|---|
| 3,937,474 A | | 2/1976 | Jepson et al. | |
| 3,975,023 A | | 8/1976 | Inamori | |
| 3,989,248 A | | 11/1976 | Campau | |
| 4,252,262 A | * | 2/1981 | Igarashi | 228/174 |
| 4,326,716 A | | 4/1982 | LaCoste | |
| 4,398,965 A | | 8/1983 | Campau | |
| 4,498,672 A | | 2/1985 | Bulla | |
| 4,687,205 A | | 8/1987 | Tominaga et al. | |
| 4,809,978 A | * | 3/1989 | Yamaguchi et al. | 273/DIG. 22 |

(List continued on next page.)

FOREIGN PATENT DOCUMENTS

| | | |
|---|---|---|
| JP | JP 05116557 | 4/1993 |
| JP | JP 07216213 | 8/1995 |
| JP | JP 09235312 | 7/1997 |
| JP | JP 10028281 | 2/1998 |

OTHER PUBLICATIONS

PCT Written Opinion and Response.
PCT Transmittal of International Preliminary Examination Report.

*Primary Examiner*—Raleigh W. Chiu
(74) *Attorney, Agent, or Firm*—Michael A. Catania; Elaine H. Lo

(57) ABSTRACT

A compliant golf club head permits a more efficient impact between a golf ball and the golf club head. Material and geometry constraints of a striking plate of the golf club head can reduce energy losses caused by large strain and strain rate values of the golf ball, these constraints on the striking plate yield a measure of the impact efficiency of the golf club head. Designating a required natural frequency range of the striking plate provides improved impact efficiency between the golf ball the golf club head.

7 Claims, 7 Drawing Sheets

U.S. PATENT DOCUMENTS 4,824,110 A 4/1989 Kobayashi
4,928,965 A 5/1990 Yamaguchi et al.
5,172,913 A 12/1992 Bouquet
5,261,663 A 11/1993 Anderson
5,261,664 A 11/1993 Anderson
5,272,802 A 12/1993 Stites, III
5,299,807 A 4/1994 Hutin
5,310,185 A 5/1994 Viollaz et al.
5,344,140 A 9/1994 Anderson
5,346,217 A 9/1994 Tsuchiya et al.
5,417,419 A 5/1995 Anderson et al.
5,429,357 A 7/1995 Kobayashi
5,431,396 A 7/1995 Shieh
5,441,256 A 8/1995 Hackman
5,431,334 A 10/1995 Sheldon et al.
5,460,371 A 10/1995 Takeda
5,464,216 A 11/1995 Hoshi et al.
5,485,998 A * 1/1996 Kobayashi ..... 473/345
5,494,281 A 2/1996 Chen
5,501,459 A 3/1996 Endo
5,505,453 A 4/1996 Mack
5,524,331 A 6/1996 Pond
5,527,034 A 6/1996 Ashcraft et al.
5,556,097 A 9/1996 Endo et al.
5,643,103 A 7/1997 Aizawa
5,703,294 A 12/1997 McConnell et al.
5,743,813 A 4/1998 Chen et al.
5,763,770 A * 6/1998 McConnell et al. ..... 473/289
5,776,011 A 7/1998 Su et al.
5,788,584 A 8/1998 Parente et al.
5,797,807 A 8/1998 Moore
5,863,261 A 1/1999 Eggiman
5,871,408 A 2/1999 Chen
5,873,791 A 2/1999 Allen
5,888,148 A 3/1999 Allen
6,001,032 A 12/1999 Onuki et al.
6,123,629 A * 9/2000 Yamaguchi et al. ..... 473/372
6,227,986 B1 5/2001 Fisher
6,238,302 B1 5/2001 Helmstetter et al.
6,273,831 B1 8/2001 Dewanjee
6,273,832 B1 8/2001 Helmstetter et al.
6,348,015 B1 * 2/2002 Kosmatka ..... 473/329
6,478,692 B2 * 11/2002 Kosmatka ..... 473/342

* cited by examiner

GOLF CLUB HEAD HAVING A STRIKING FACE WITH IMPROVED IMPACT EFFICIENCY

CROSS REFERENCE TO RELATED APPLICATIONS

This application is a continuation application of U.S. patent application Ser. No. 09/683,799, filed on Feb. 15, 2002 now U.S. Pat. No. 6,478,692, which is a continuation-in-part application of U.S. patent application Ser. No. 09/525,216 filed on Mar. 14, 2000, now U.S. Pat. No. 6,348,015 issued Feb. 19. 2002.

FEDERAL RESEARCH STATEMENT

[Not Applicable]

BACKGROUND OF THE INVENTION

1. Field of the Invention

The present invention relates to a golf club head. More specifically, the present invention relates to a face section of a golf club head to reduce energy losses when impacting a golf ball.

2. Description of the Related Art

Technical innovation in the material, construction and performance of golf clubs has resulted in a variety of new products. The advent of metals as a structural material has largely replaced natural wood for wood-type golf club heads, and is but one example of this technical innovation resulting in a major change in the golf industry. In conjunction with such major changes are smaller scale refinements to likewise achieve dramatic results in golf club performance. For example, the metals comprising the structural elements of a golf club head have distinct requirements according to location in the golf club head. A sole or bottom section of the golf club head should be capable of withstanding high frictional forces for contacting the ground. A crown or top section should be lightweight to maintain a low center of gravity. A front or face of the golf club head should exhibit high strength and durability to withstand repeated impact with a golf ball. While various metals and composites are known for use in the face, several problems arise from the use of existing materials.

Existing golf club face materials such as stainless steel exhibit desired high strength and durability but incur large energy losses during impact with the golf ball as a result of large ball deformations. An improvement in impact energy conservation, in conjunction with proper golf ball launch parameters, is a design goal for golf club manufacturers. The problem still exists of identifying a combination of material properties exhibiting improvements in conservation of impact energy during impact with the golf ball.

SUMMARY OF INVENTION

When a golf club head strikes a golf ball, large impact forces are produced that load a face section, also called a striking plate, of the golf club head. Most of the energy is transferred from the golf club head to the golf ball; however, some energy is lost as a result of the impact. The present invention comprises a golf club striking plate material and geometry having a unique combination of material properties for improved energy efficiency during impact with the golf ball.

The golf ball is typically a core-shell arrangement composed of polymer cover materials, such as ionomers, surrounding a rubber-like core. The golf ball materials have stiffness properties defined as the storage and loss moduli for compression ($E'_{ball}$,$E''_{ball}$) and storage and loss moduli for shear ($G'_{ball}$,$G''_{ball}$) that are strain (or load), strain rate (or time rate of loading), input frequency, and temperature dependent. The compression loss factor ($\eta_E$) and shear loss factor ($\eta_G$) (damping or energy loss mechanisms), which are defined as the ratio of loss modulus to the storage modulus, are also strain, strain rate, input frequency, and temperature dependent. The golf ball loss factors, or damping level, is on the order of 10–100 times larger than the damping level of a metallic golf club striking plate. Thus, during impact most of the energy is lost as a result of the large deformations, typically 0.05 to 0.50 inches, and deformation rates of the golf ball as opposed to the small deformations of the metallic striking plate of the golf club head, typically 0.025 to 0.050 inches.

By allowing the golf club head to flex and "cradle" the golf ball during impact, the contact region as well as contact time between the golf ball and the striking plate of the golf club head are increased, thus reducing the magnitude of the internal golf ball stresses as well as the rate of the stress build-up. This results in smaller golf ball deformations and lowers deformation rates, both of which produce much lower energy losses in the golf ball during impact. The static flexibility is inversely proportional to the striking plate stiffness, while the dynamic flexibility is inversely proportional to square of the striking plate bending natural frequency. In other words, a decrease in plate stiffness will cause the static flexibility to increase, while doubling the plate bending natural frequency will reduce dynamic flexibility to a level ¼ of the original striking plate. Increasing the static or dynamic flexibility can be accomplished via several different configurations for the golf club head: altering geometry of the face section; altering attachment of the striking plate to the club-head body; reducing the thickness of the striking plate; or through the innovative use of new structural materials having reduced material stiffness and/or increased material density. Material strength of the striking plate of the golf club head in conjunction with impact load from contact with the golf ball determines the minimum required thickness for the face section. The greater the available material strength, the thinner the striking plate can be, and thus greater the flexibility. So the material properties that control static and dynamic flexibility are decreased compression stiffness, increased density, and increased strength. The present invention specifies which face materials and static/dynamic flexibilities provide improved energy conservation during impact of the golf club head and the golf ball. Materials used in the face section of the golf club head constitute an additional important factor in determining performance characteristics of coefficient of restitution (COR), launch angle, spin rate and durability.

One object of the present invention is to improve impact efficiency between a golf club head and the golf ball.

Another object is to designate a range of material properties to increase the static flexibility, otherwise described as reduced bending stiffness, of the striking plate of the golf club head. Any number of materials having requisite limitations of stiffness and strength can be utilized in the manufacture of the golf club of the present invention to produce a compliant, or softer flexing performance during impact with the golf ball.

Another object is to designate a range of material properties to increase the dynamic flexibility, otherwise described as reduced bending natural frequency, of the striking plate of the golf club head. Any number of materials having requisite limitations of stiffness and strength can be utilized in the manufacture of the golf club of the present invention to produce a compliant, or softer flexing performance during impact with the golf ball.

A further object of the present invention is a wood-type golf club head having a face section of a first material and a body section of a second material.

Another object of the present invention is a wood-type golf club head having a face section of a metal material.

Another object of the present invention is a wood-type golf club head having a face section of a non-metal material.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
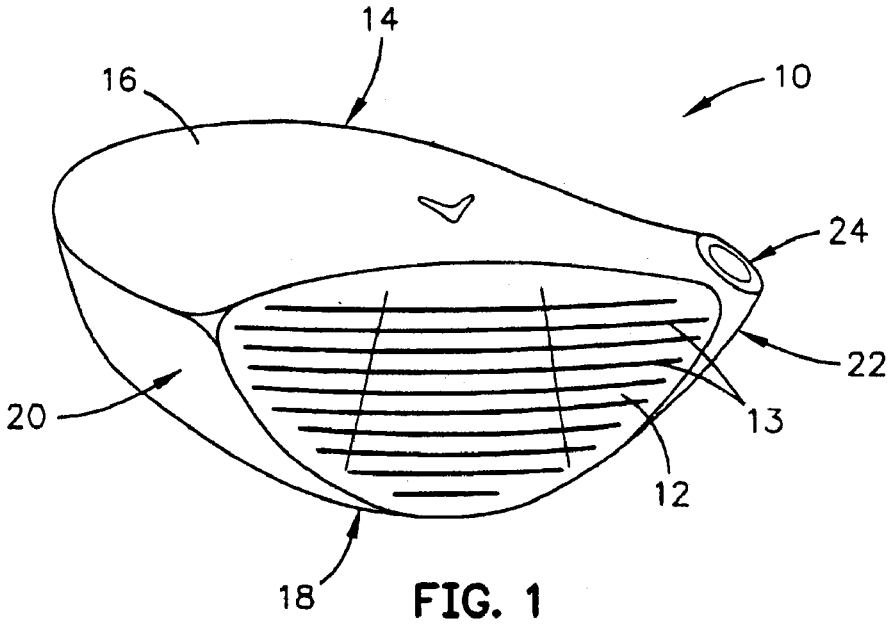
FIG. 1 is a perspective view of a golf club head of an embodiment of the present invention.

As shown in FIG. 1 a wood-type golf club head 10 comprises a face section 12, a rear section 14, a top section 16, a bottom section 18, a toe section 20, a heel section 22 and a hosel inlet 24 to accept a golf shaft (not shown). The golf club head 10 is a unitary structure which may be composed of two or more elements joined together to form the golf club head 10. The face section 12, also called a striking plate, is an impact surface for contacting a golf ball (not shown). Structural material for the golf club head 10 can be selected from metals and non-metals, with a face material exhibiting a maximum limit for face stiffness and natural frequency being a preferred embodiment.

Figure 2:
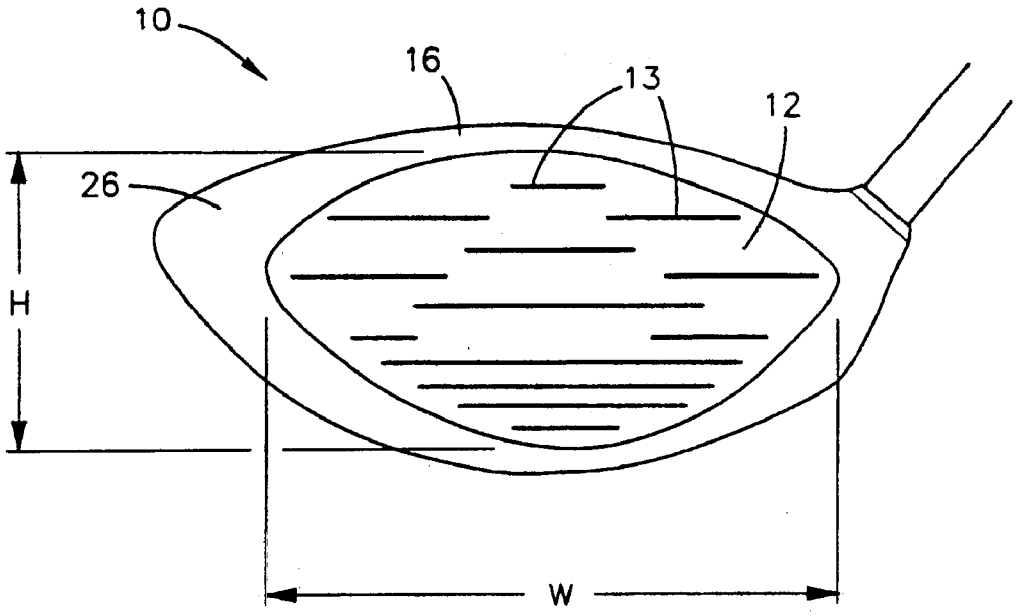
FIG. 2 is a front view of a golf club head showing a striking plate with a major cross-section dimensional width (W) and a minor cross-section dimensional height (H).

The present invention is directed at a golf club head 10 having a striking plate 12 that makes use of materials to increase striking plate flexibility so that during impact less energy is lost, thereby increasing the energy transfer to the golf ball. This increased energy transfer to the golf ball will result in greater impact efficiency. The striking plate 12 is generally composed of a single piece of metal or nonmetallic material and may have a plurality of score-lines 13 thereon. The striking plate 12 may be cast with a body 26, or it may be attached through bonding or welding to the body 26. See FIGS. 1 and 2.

Figure 3:
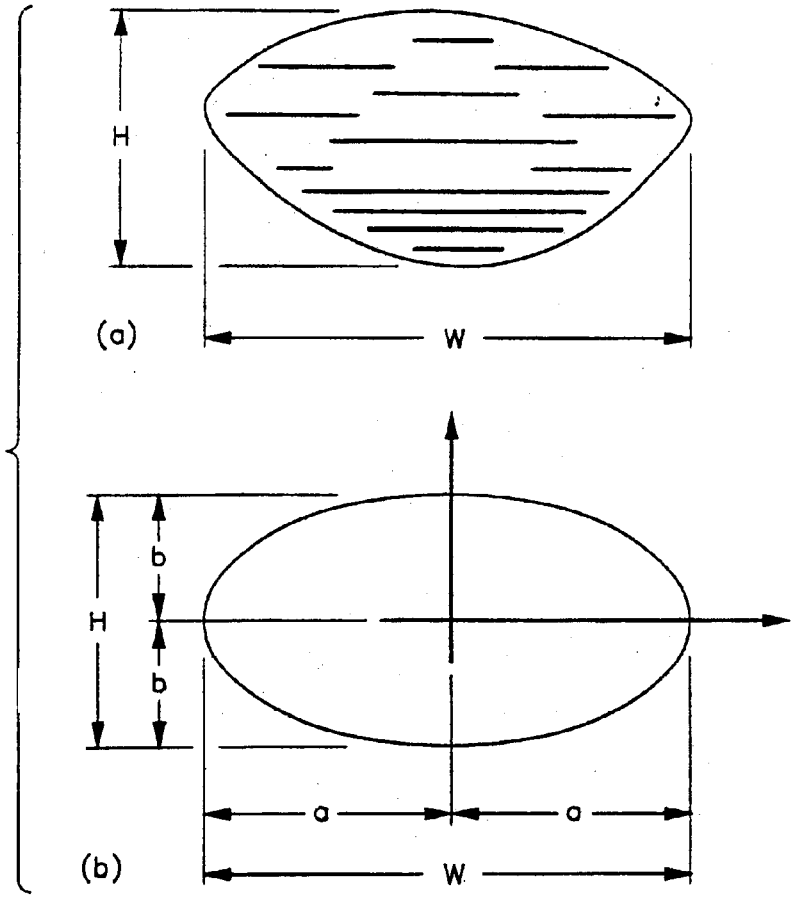
FIG. 3 shows a striking plate having an elliptical shape with a major and a minor cross-section dimensions (W) and (H), respectively, of an embodiment of the present invention.
Figure 4:
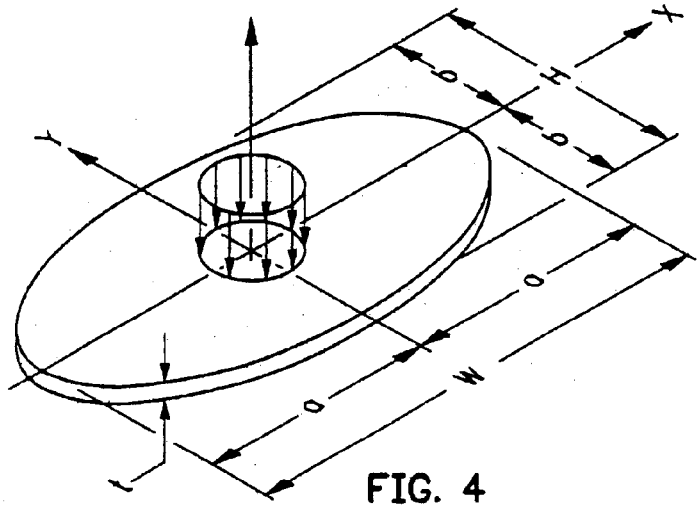
FIG. 4 shows an elliptical plate with a pressure loading over a central circular region.

For explanation purposes, the striking plate 12 is treated as an elliptical shaped cross section having a uniform thickness, denoted as "t" in FIG. 4, that is subjected to a distributed load over a small circular region at the center of the striking plate 12. See FIGS. 3 and 4. Those skilled in the pertinent art will recognize that striking plates having other shapes, nonuniform thickness distribution, and force locations are within the scope and spirit of the present invention. The overall cross-section width is given by (W=2*a*), the overall cross-section height (H=2*b*), and the striking plate aspect ratio is defined as ($\alpha$=b/a). The impact load, resulting from impact of the golf ball with the golf club head 10, is treated as force of magnitude (F), acting with a pressure (q) over a circular region of radius ($r_o$) in the center of the elliptical plate so that $$F = \int_0^{2\pi} \int_0^{r^*} qr\,dr\,d\theta.$$

Figure 5:
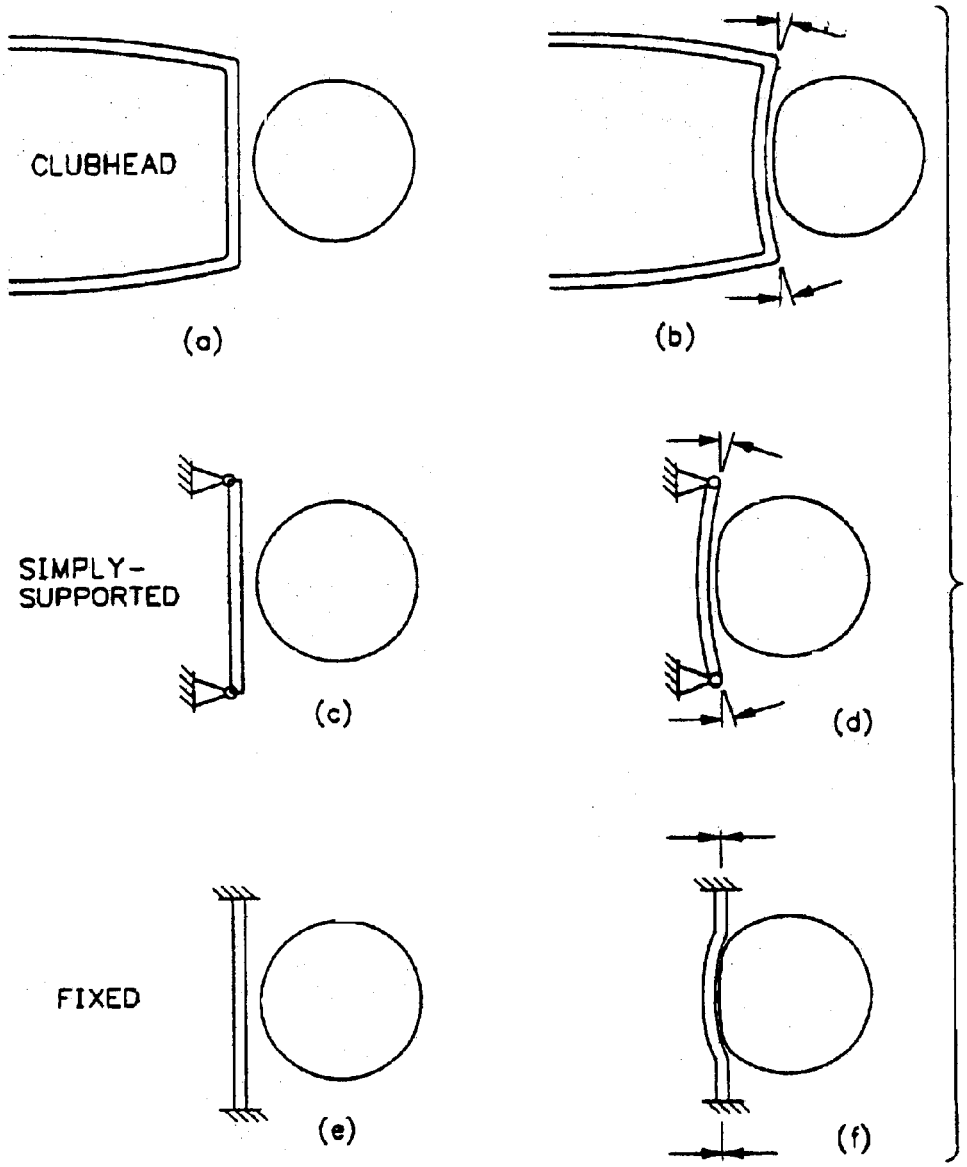
FIG. 5*a* shows the face section of the club head, of an embodiment of the present invention, prior to impact with the golf ball.
FIG. 5*b* shows deformation of the striking plate of the golf club head, of an embodiment of the present invention, during impact with the golf ball.
FIG. 5*c* shows an elliptical striking plate having a simply-supported edge constraint prior to impact with the golf ball.
FIG. 5*d* shows deformation of the elliptical striking plate of FIG. 5*c* during impact with the golf ball.
FIG. 5*e* shows an elliptical striking plate having a fixed edge constraint prior to impact with a golf ball.
FIG. 5*f* shows the elliptical striking plate of FIG. 5*e* during impact with the golf ball.

Like other striking plates of the prior art, the striking plate 12 of the present invention is positioned between the top section 16 and bottom section 18. During impact with the golf ball, the striking plate 12 will deflect depending upon the connection to the top section 16 and the bottom section 18, see FIG. 5*a–f*. The two extreme limiting cases for all possible boundary attachment conditions are defined as "simply-supported" where the elliptical edge of the striking plate is constrained from translating but the edge is free to rotate, see FIG. 5*c* and 5*d*, and "fixed" or "clamped" where the elliptical edge is fixed from both translating and rotating, see FIG. 5*e* and 5*f*. The boundary attachment for the striking plate 12 to the body 26 of the club head 10 will fall between the two limiting cases since the top section 16 and bottom section 18 will provide some stiffening to the striking plate 12, but in general are very close to the simply supported condition. The calculated maximum stress in the striking plate as a result of the applied loading is $$\sigma = \frac{3(1+\nu)RF^*}{2\pi t^2}$$

where (F*) is the maximum load that includes the effects of design safety factors and the score-line 13 stress concentration factors, (t) is the plate thickness, ($\nu$) is the material Poisson ratio, and (R) depends upon the plate geometry (a,b), load radius, material Poisson ratio, and edge support conditions. For golf club heads, the top section 16 and bottom section 18 provide some stiffening to the striking plate 12 edge, (R) will fall between the simply-supported edge and the fixed support, but for this invention it is very close to the simply-support edge condition;

$$R_{simply\text{-}sup\,port} = \ln\left(\frac{b}{r_o}\right) + \frac{v}{(1+v)}(6.57 - 2.57\alpha)$$

$$R_{fixed} = \ln\left(\frac{2b}{r_o}\right) - .317\alpha - .376.$$

The minimum required thickness of the striking face based upon the applied loading is determined by setting the maximum stress to the allowable material yield stress ($\sigma_{yield}$) and solving;

$$t = \sqrt{\frac{3(1+v)RF^*}{2\pi\sigma_{yield}}}.$$

The minimum required striking plate thicknesses for two different materials (materials A and B) can be directly compared using Equation (IV), if one assumes that the impact forces, the plate geometry (W, H), and the edge boundary constraints are nearly the same. Writing the ratio of the minimum required thicknesses for two different materials is $$\frac{t_A}{t_B} = \sqrt{\left(\frac{\sigma_{yield-B}}{\sigma_{yield-A}}\right)\left(\frac{1+v_A}{1+v_B}\right)},$$

where ($t_A$) and ($t_B$) are the minimum required thicknesses for plates composed of materials A and B, respectively, and ($\sigma_{yield-A}$, $v_A$) and ($\sigma_{yield-B}$, $v_B$) are the material properties of A and B, respectively. A weight ratio comparison of two minimum thickness striking plates is equal to $$\frac{W_A}{W_B} = \frac{\rho_A t_A \pi ab}{\rho_B t_B \pi ab} = \frac{\rho_A}{\rho_B}\sqrt{\left(\frac{\sigma_{yield-B}}{\sigma_{yield-A}}\right)\left(\frac{1+v_A}{1+v_B}\right)},$$

where ($\rho_A$) and ($\rho_B$) are the densities of material A and B, respectively, and these plates have identical geometry (W, H), boundary constraints, and are designed to withstand the same load (F*).

Static Flexibility

The calculated striking plate static flexibility (S), which is the inverse of the plate stiffness, is defined as the calculated center displacement of the striking plate 12 divided by the plate force (F*) and is equal to:

$$S = \frac{b^2}{Et^3}P,$$

where (b) is half the height of the striking plate 12, (E) is Young's modulus and (P) depends upon the geometry and the support conditions of the elliptical plate. For golf heads, (P) will fall between the simply-supported and fixed edge conditions, but for this invention it falls very close to the simply-supported edge condition;

$$P_{sharply\text{-}sub\,port} = (0.76 - 0.18\alpha)$$

$$P_{fixed} = (0.326 - 0.104\alpha)$$

Thus, increased striking plate flexibility can be accomplished by increasing the striking plate height (b), decreasing the Young's modulus (E), also described as material stiffness, or by reducing the plate thickness (t). But the plate thickness can only be reduced to the minimum allowable thickness from Equation (IV). Substituting Equation (IV) into (VII), results in the static flexibility having a minimum allowable plate thickness;

$$S = \left[\frac{1}{E}\left(\frac{\sigma_{yield}}{1+v}\right)^{\frac{3}{2}}\right]\left[Pb^2\left(\frac{2\pi}{3RF^*}\right)^{\frac{3}{2}}\right],$$

where the first bracketed term depends upon the striking plate material properties, the second bracketed term depends upon the face geometry.(a, b, $\alpha$), edge attachment constraints (P, R), and impact load definition (F*). Assuming the plate geometry, edge attachment, and the impact load are the same for two different designs (second bracketed term of Equation IX), then to maximize the static flexibility, one needs to select a material having the largest ratio of:

$$\frac{1}{E}\left(\frac{\sigma_{yield}}{1+v}\right)^{\frac{3}{2}}.$$

The static flexibility of two materials (A) and (B) can be compared, for a given plate geometry, edge attachments, and applied load by writing Equation (IX) as a ratio $$\frac{S_A}{S_B} = \left(\frac{E_B}{E_A}\right)\left(\frac{\sigma_{yield-A}}{\sigma_{yield-B}}\right)^{\frac{3}{2}}\left(\frac{1+v_B}{1+v_A}\right)^{\frac{3}{2}},$$

where ($S_A$) and ($S_B$) are the static flexibilities of a plate having a minimum plate thickness for materials A and B, respectively and ($E_A$) and ($F_B$) are the material stiffnesses for materials A and B, respectively.

Bending Natural Frequency

The calculated bending natural frequency ($\omega$), or referred to simply as natural frequency, having units of cycles/second (Hz), for the elliptical striking plate is given by;

$$\omega(\text{Hz}) = \frac{\lambda t}{b^2}\sqrt{\frac{Eg}{\rho(1-v^2)}}$$

where ($v$) is the material Poisson ratio, (b) is half the height of the striking plate 12, ($\rho$) is the material weight density, (g) is the gravitational constant (32.2 ft/sec $^2$), and ($\lambda$) depends upon the geometry and the support conditions of the elliptical plate, as well as the desired vibration mode. For golf club heads, ($\lambda$) will fall between the two limiting edge support values, simply-support and fixed, but for this invention it is very close to the simply-support condition;

$$\lambda_{simply\text{-}sup\,port} = .124\sqrt{1 + .21\alpha + 2.37\alpha^2 - 3.03\alpha^3 + 2.7\alpha^4}$$

$$\lambda_{fixed} = .2877\sqrt{1 + 2/3\alpha^2 + \alpha^4}.$$

The bending natural frequency can be minimized by increasing the striking plate 12 height (2*b*) or aspect ratio ($\alpha$), increasing the material density ($\rho$), decreasing the material stiffness (E), or decreasing the plate thickness (t). But the plate thickness can only be reduced to the minimum allowable thickness from Equation (IV). Substituting Equation (IV) into (XII), results in the natural frequency having a minimum allowable plate thickness;

$$\omega = \left[\sqrt{\frac{E}{\sigma_{yield}\rho(1-\nu)}}\right]\left[\frac{\lambda}{b^2}\sqrt{\frac{3gRF^*}{2\pi}}\right]$$

where the first bracketed term depends upon the striking plate material properties, the second bracketed term depends upon the face geometry (a, b, α), edge attachment constraints (R), and impact load definition (F*). Assuming the plate geometry, edge attachment, and the impact load are the fixed (second bracketed term of Equation XIV), then to minimize the natural frequency, one needs to select a material having the smallest of:

$$\frac{E}{\sigma_{yield}\rho(1-\nu)}$$

The natural frequency of two materials (A) and (B) can be compared, for a given plate geometry, edge attachments, and applied load by writing Equation (XIV) as a ratio $$\frac{\omega_A}{\omega_B} = \sqrt{\left(\frac{E_A}{E_B}\right)\left(\frac{\sigma_{yield-B}}{\sigma_{yield-A}}\right)\left(\frac{\rho_B}{\rho_A}\right)\left(\frac{1-\nu_B}{1-\nu_A}\right)},$$

where ($\omega_A$) and ($\omega_B$) are the natural frequencies of a striking plate having a minimum plate thickness for materials A and B.

A golf club head has a large number of natural frequencies, where some involve the vibratory motion that characterize the striking plate, others involve motion that characterize the top plate or bottom plate, and still others involve the combined motion of the striking plate and other parts of the club head. The natural frequencies that are of concern in the present invention involve the full or partial vibratory motion of the striking plate. Thus, to experimentally measure these frequencies, one needs to excite the striking plate as well as record its response. A noncontacting excitation and response system is preferred to insure that added mass or stiffness effects do not artificially alter the results. In our experimental studies, the striking plate was excited using either an impact hammer (PCB Inc. of Buffalo, N.Y., model 068, series 291; or Kistler Instrument Corp. of Amherst, N.Y., model 9722A500) or an acoustical funnel-cone speaker, where the speaker is driven with broad-band white random noise between 1000–10,000 Hz. The velocity time history (response) is measured using a laser velocimeter (Polytec Pl GmbH of Waldbronn, Germany, model OFV-303 or PSV-300; or Ometron Inc. of London, England, model VPI-4000). The recorded excitation and response time histories are processed using a two-channel spectrum analyzer (Hewlett Packard of Palo Alto, Calif.) to determine the frequency content of the response signal divided by the excitation signal. The spectrum analyzer has input/output windowing features and anti-aliasing filters to eliminate processing errors. The test is repeated a minimum of 10 times and the data is averaged to minimize the effects of uncorrelated noise. Thus the coherence was found to be greater than 0.98 at all measured natural frequencies. The tests are repeated using numerous excitation and response locations on the striking plate to insure that the lowest striking plate dominated natural frequencies are recorded.

Dynamic Flexibility

The dynamic flexibility (D) for the striking plate is given by $$D = \frac{1}{m_e(2\pi\omega)^2},$$

where, (ω) is the striking plate natural frequency, and ($m_e$) is the effective face mass that contributes to the dynamic response during impact:

$$m_e = \beta\frac{\rho}{g}\pi tab = \beta\frac{\rho}{g}\pi t\frac{b^2}{\alpha}.$$

Here (β) is defined between (0) and (1), where (0) is associated with no face mass contributing to the dynamic response and (1) having all of the face mass contributing to the response. For golf clubs, (0.15<β<0.35). Writing the dynamic flexibility by substituting Equations (XIV) and (XVIII) into (XVII):

$$D = \frac{b^2}{Et^3}\left(\frac{\alpha(1-\nu^2)}{4\beta\pi^3\lambda^2}\right).$$

The striking plate dynamic flexibility can be increased by enlarging the plate depth (b) or aspect ratio (α), decreasing the material stiffness (E), or decreasing the plate thickness (t). Clearly the greatest increase in (D) can be found by changing the thickness (t), followed by changing the face height (2*b*). But, the plate thickness can only be reduced up to the allowable value of Equation (IV). Thus, the maximum dynamic flexibility (D) for a given plate geometry and applied load is calculated by substituting the minimum allowable thickness Equation (IV) into (XIX);

$$D = \left[\frac{(1-\nu^2)}{E}\left(\frac{\sigma_{yield}}{(1+\nu)}\right)^{\frac{3}{2}}\right]\left[\left(\frac{ab^2}{4\beta\pi^3\lambda^2}\right)\left(\frac{2\pi}{3RF^*}\right)^{\frac{3}{2}}\right]$$

where the first bracketed term depends upon the striking plate material properties, the second bracketed term depends upon the face geometry (a, b, α), edge attachment constraints (λ, R), and impact load definition (F*). Assuming the plate geometry, edge attachment, and the impact load are constant (second bracketed term of Equation XX), then to maximize the dynamic flexibility (D), one needs to select a material having the largest ratio of:

$$\frac{(1-\nu^2)}{E}\left(\frac{\sigma_{yield}}{(1+\nu)}\right)^{\frac{3}{2}}$$

The dynamic flexibility of two materials (A) and (B) can be compared, for a given plate geometry, edge attachments, and applied load by writing Equation (XX) as a ratio $$\frac{D_A}{D_B} = \left(\frac{E_B}{E_A}\right)\left(\frac{1-\nu_A^2}{1-\nu_B^2}\right)\left(\frac{\sigma_{yield-A}}{\sigma_{yield-B}}\right)^{\frac{3}{2}}\left(\frac{1+\nu_B}{1+\nu_A}\right)^{\frac{3}{2}},$$

where ($D_A$) and ($D_B$) are the maximum dynamic flexibilities of a plate having a minimum plate thickness for materials A and B, respectively.

Figure 6:
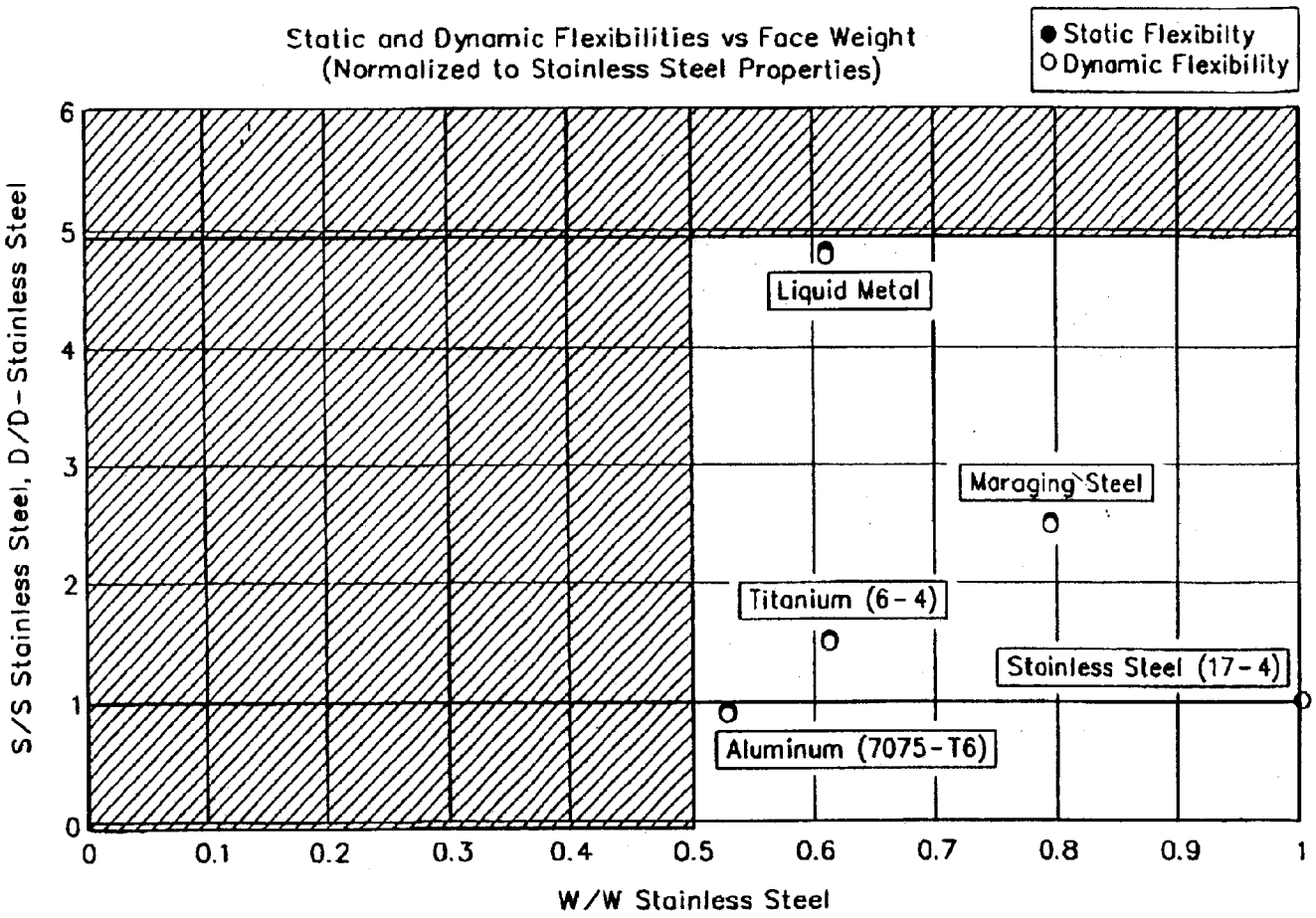
FIG. 6 is a plot of the normalized static and dynamic flexibility versus the face weight for a minimum weight design
Figure 7:
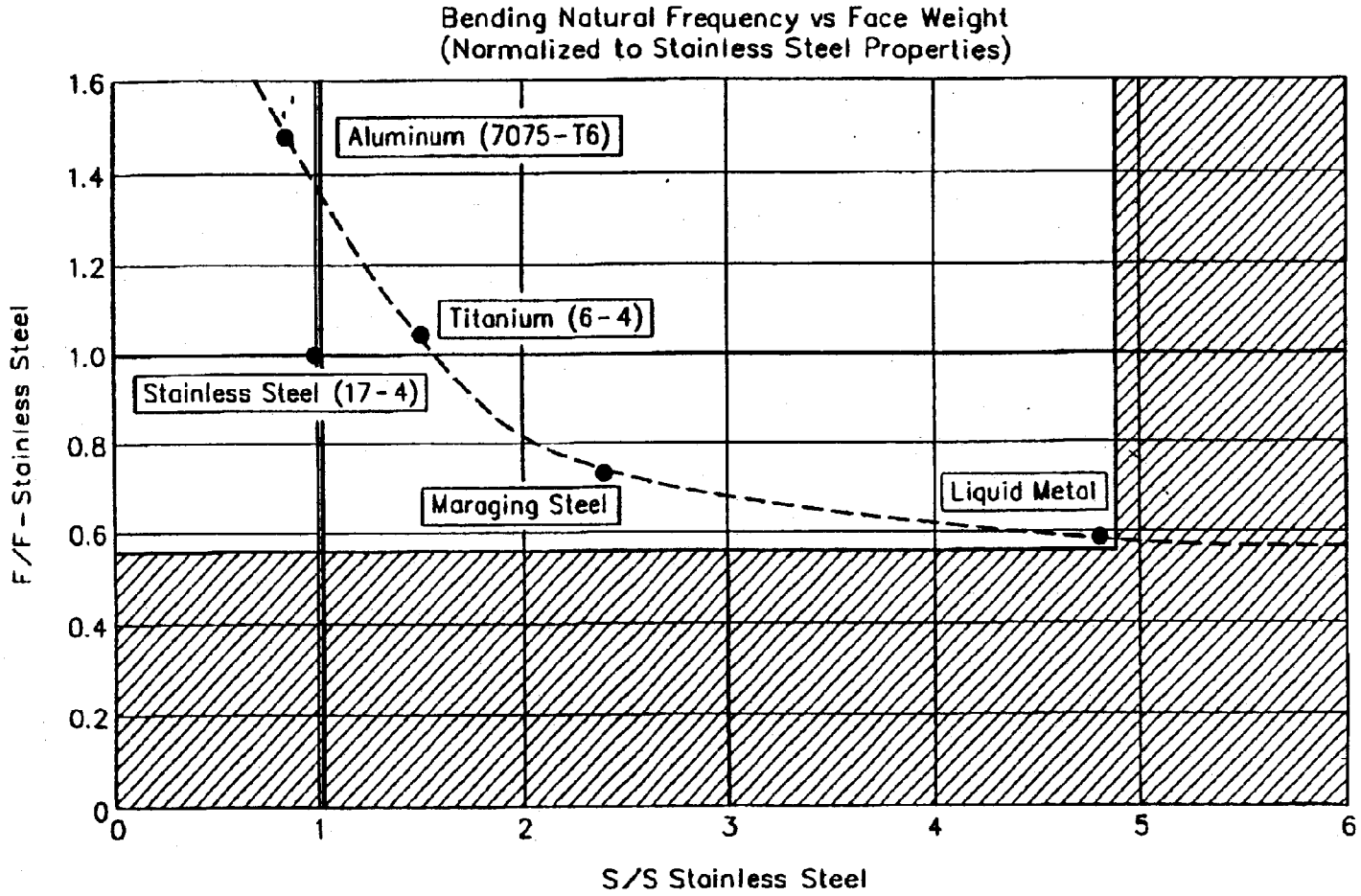
FIG. 7 is a plot of the bending natural frequency versus the static flexibility for a minimum thickness design.

For wood-type golf clubs the following geometry and force properties are typical (a=1.4–1.65 inch, b=0.7–1.0 inch, t=0.14–0.25 inch, F*=2000–15,000 lbs). In Table 1, current metal golf club head material properties are given along with five different golf club head property ratios. These five different ratios include: minimum required striking plate thickness (Eq. V), resulting striking plate weight (Eq. VI), static flexibility (Eq. XI), bending natural frequency (Eq. XVI), and dynamic flexibility (Eq. XXII), where the baseline (B) material is taken as (17-4) Stainless Steel. These ratios provide a comparison of striking plates that have identical elliptical geometry, edge attachment, and load capacity, but are composed of different materials and thus will have different minimum striking plate thicknesses. A normalized comparison of the static flexibility and dynamic flexibility to face weight is presented in FIG. 6, where all results are normalized to an equivalent (17-4) Stainless Steel striking plate. In FIG. 6. it is clear that the amorphous alloy striking plate and maraging striking plate offer (4.8) and (2.5) times more flexibility and lower face weight than stainless steel as a result of their high strength, while the titanium alloy striking plate offers 50% more flexibility and lower face weight as a result of significantly lower modulus, but that the aluminum alloy striking plate results in lower flexibility as a result of its lower strength. These increases in flexibility lead to reduced impact energy losses, which in turn lead to greater golf ball flight velocities. In FIG. 7, a comparison of normalized face natural frequency versus static flexibility is presented, where a correlation exists between measured natural frequency and static flexibility, and thus natural frequency can be used as a simple nondestructive measurement technique for assessing the magnitude of the static and dynamic flexibility. It is observed that the amorphous alloy and maraging steel striking plates have a lower natural frequency and greater flexibility than other materials in FIG. 7 because of their high strength and density. The titanium alloy striking plate and aluminum alloy striking plate have natural frequencies higher than all the other materials in FIG. 7 because of their low density.

A detailed inspection of Table 1 reveals that striking plates composed of Maraging 280 steel or the amorphous alloy are 23% thinner than the 17-4 Stainless Steel striking plate, which is a direct result of higher strength of these materials. In a preferred embodiment the striking plate of stainless steel has a maximum thickness of less than 0.130 inches, and more preferably between 0.130 and 0.070 inches, while both the maraging steel and amorphous alloy have a striking plate thickness of less than 0.100 inches, and more preferably between 0.100 and 0.070 inches. The Aluminum 7075-T6 striking plate is thickest because of its low strength, but it is the lightest as a result of its low density. In a preferred embodiment the striking plate of aluminum alloy has a maximum thickness of less than 0.200 inches, and more preferably between 0.200 and 0.070 inches. The striking plates composed of an amorphous alloy, Maraging 280 steel, and the 6-4 Titanium all have static and dynamic flexibilities much greater than the 17-4 Stainless Steel striking plate (480%, 240% and 150%), while the aluminum alloy striking plate has a 12% lower flexibility as a result of its large thickness. Finally, the striking plates composed of amorphous alloy and maraging steel have bending natural frequencies which are 41% and 27% lower, respectively, than the 17-4 Stainless Steel striking plate, whereas the titanium alloy striking plate is nearly the same as the stainless steel, while the aluminum alloy striking plate is 50% greater as a result of an increased thickness and low density.

It should be further pointed out, that most golf club designers use the striking plate weight savings to further increase the size of the striking plate (i.e. oversize titanium drivers) and thus further increase its static and dynamic flexibility.

Table 1: Typical Material Properties used in Golf Club Faces and Comparison Ratios

TABLE 1

Typical Material Properties used in Golf Club Faces and Comparison Ratios

| Material (i) | E $10^6$ lb/in$^2$ | v | $\sigma_{yield}$ $10^3$ lb/in$^2$ | ρ lb/in$^3$ | $t_i/t_{steel}$ | $W_i/W_{steel}$ | $S_i/S_{steel}$ | $\omega_i/\omega_{steel}$ | $D_i/D_{steel}$ |
|---|---|---|---|---|---|---|---|---|---|
| Stainless Steel(17-4) | 29.0 | .27 | 150 | .276 | 1.00 | 1.00 | 1.00 | 1.00 | 1.00 |
| Aluminum (7075-T6) | 10.4 | .33 | 73 | .101 | 1.47 | 0.54 | 0.88 | 1.48 | 0.85 |
| Titanium (Ti 6-4) | 16.0 | .31 | 138 | .160 | 1.06 | 0.61 | 1.53 | 1.05 | 1.49 |
| Maraging 280 Steel | 26.5 | .31 | 262 | .285 | 0.77 | 0.79 | 2.41 | 0.73 | 2.35 |
| Amorphous Alloy | 13.3 | .30 | 260 | .220 | 0.77 | 0.61 | 4.80 | 0.59 | 4.72 |

Figure 8:
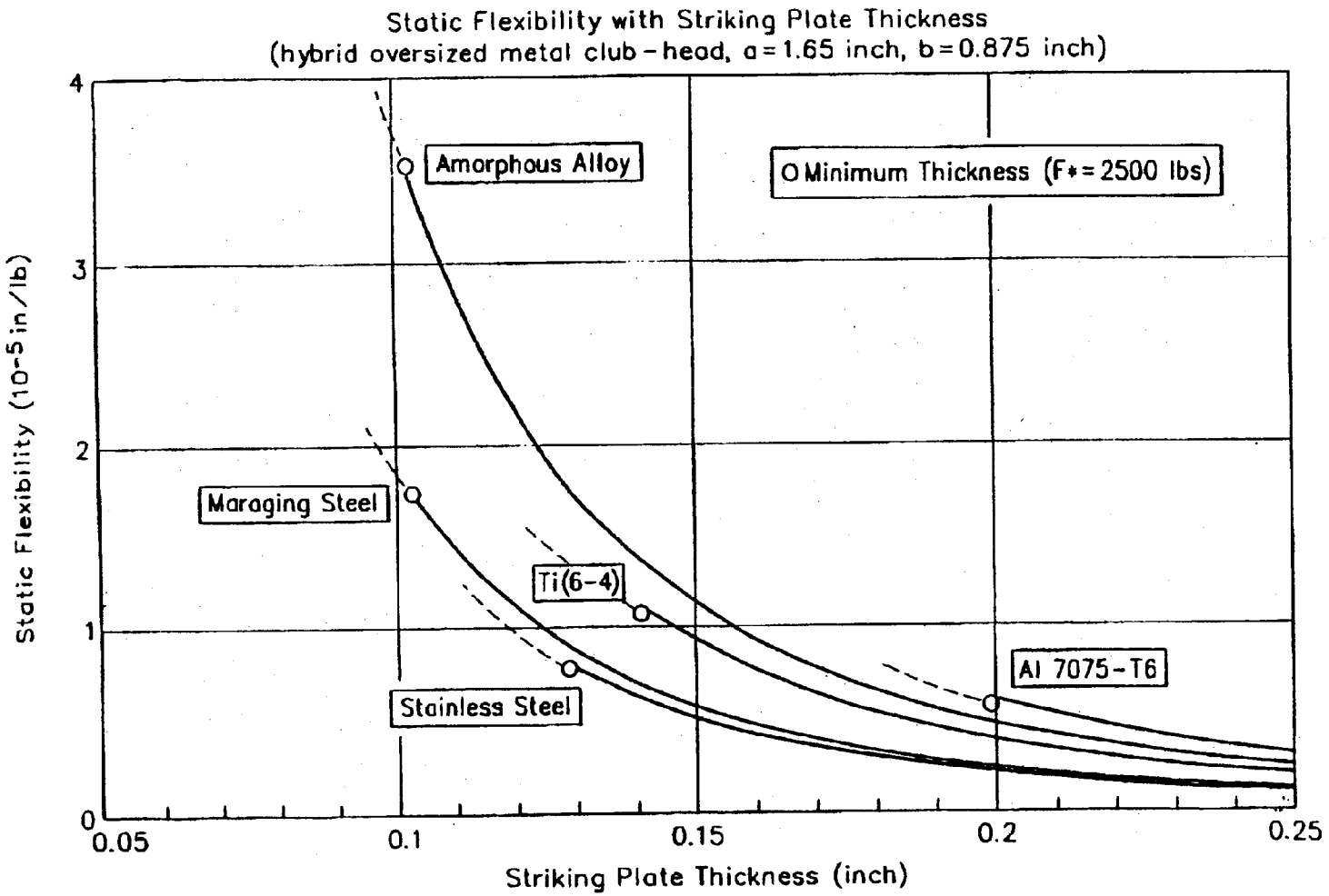
FIG. 8 is a plot of the static flexibility versus striking plate thickness for a large club head utilizing five different materials for the golf club striking plate.
Figure 9:
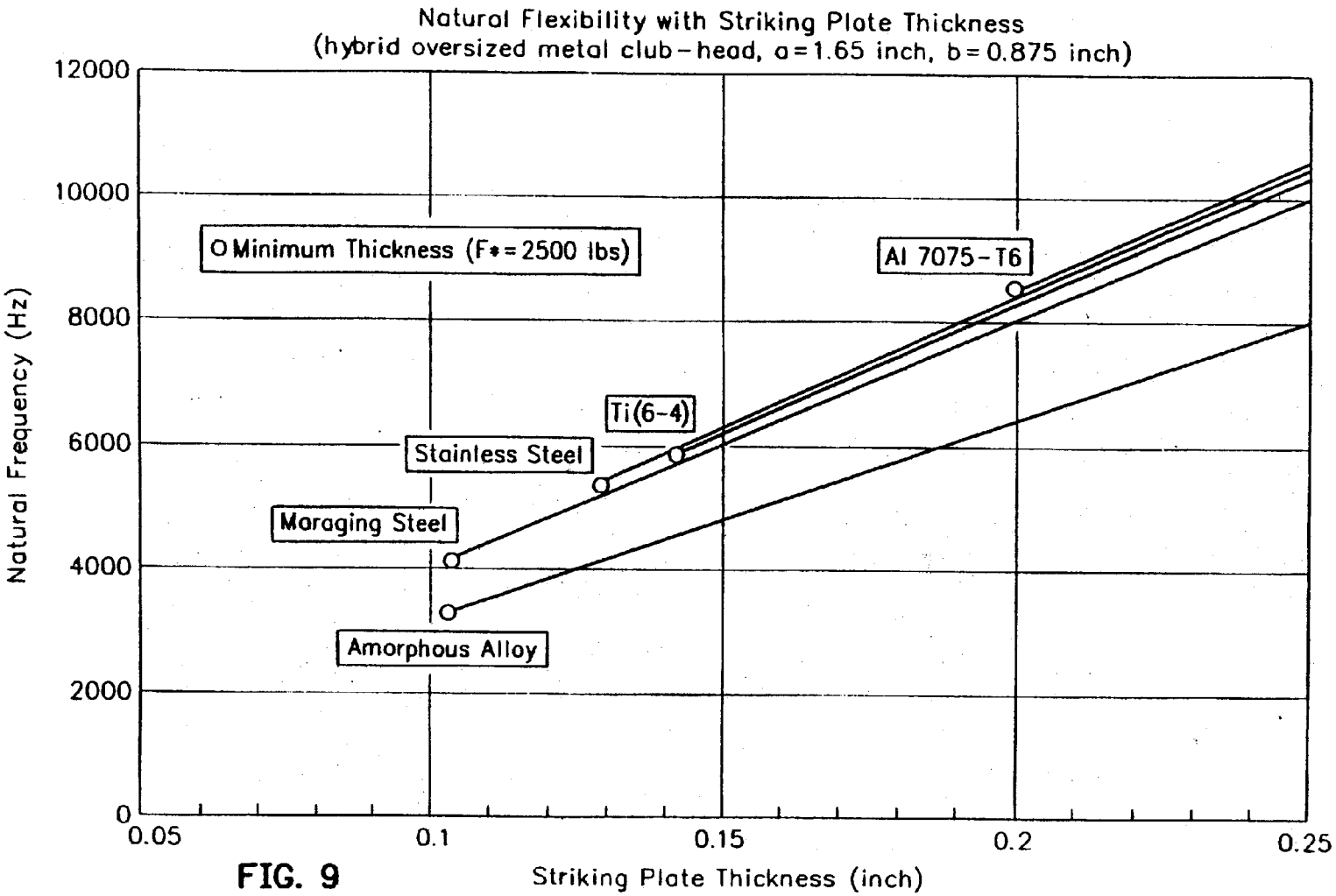
FIG. 9 is a plot of the natural frequency versus striking plate thickness for a large club head utilizing five different golf club striking plate materials.

As a second example, consider a very large oversized driver head similar to a Callaway Golf® Biggest Big Bertha driver that is fabricated with different material striking plates. The geometry values are defined as (a=1.65 inch. b32 0.875 inch, $\alpha$=0.530). In order to produce striking plate flexibility levels greater than found in any current club-head: (1) the striking plate has no scorelines, thus (F*=2500 lbs) with a radius ($r_o$=0.50 inch), and (2) the edge attachment condition is nearly simply-supported so that (P=0.664, A=0.1538). Constructing the striking plate out of Titanium (Ti 6-4), leads to (R=1.792) and a minimum required face thickness of (t=0.143 inch). Including score-line stress concentration factors will simply increase (F*), thus increasing the required face thickness (t) and bending natural frequency, and decreasing the flexibility. The calculated weight is (W=0.103 lb), the static flexibility is (S=1.10×10 $^{-5}$ in/lb), the natural frequency ($\omega$=5920 Hz), and the dynamic flexibility (D=1.08×10 $^{-5}$ in/lb), where it was assumed ($\beta$=0.25). The calculated head natural frequency of 5920 Hz is within 2% of the experimentally measured value of 6040 Hz on an actual experimental hybrid golf club head. The maximum displacement of the striking plate is found by multiplying the static flexibility and the effective force (F*), thus (Δ=0.0275 inch). Hybrid golf club heads having different material striking face plates are presented in Table 2, where the striking plates have minimum allowable face thicknesses. In FIGS. 8 and 9, the variation of the static flexibility and natural frequency with striking plate thickness is presented for the five different metals, where the symbol (o) is used to represent the minimum allowable thickness fore a assumed applied load (F*=2500 lbs). Clearly, if the applied load were increased then the minimum allowable thicknesses would increase, where the symbols would just move to the right along the appropriate curve. Thus lowering the flexibility and increasing the natural frequency. Moreover, if a higher strength version of an alloy were used, then the symbol would follow the curve to the left and thus increase the flexibility and lower natural frequency. It is observed that the greatest flexibility occurs for maraging steel and the amorphous alloy, which has the thinnest striking plates and lowest natural frequencies.

It is known through experimental testing, that currently available driver golf club heads have striking-face natural frequencies greater than 4500 Hz. Moreover, the only commercially available golf club head with an amorphous alloy striking plate (commercial name: Liquid Metal™) has a fundamental striking plate natural frequency of 5850 Hz. Thus, the striking plates on these club heads are not optimized for maximum flexibility. They do not have a minimum thickness striking plate, a large aspect ratio, or an edge support that simulates the simply supported constraint. From Equation XVII, the dynamic flexibility is inversely proportional to the square of the natural frequency, thus these heads have a flexibility that is much lower and a face thickness that is much greater than the optimized minimum values presented in the previous example (i.e. their values on FIGS. 8 and 9 would be to the far right of the minimum allowable thickness). In a preferred embodiment of the present invention, the material of striking plate 12 has a natural frequency of less than 4500 Hz, in a more preferred embodiment the striking plate 12 natural frequency is between 4500 Hz and 2800 Hz. For the aluminum alloy striking plate 12, the natural frequency is below 8500 Hz, and in a more preferred embodiment the natural frequency is between 8500 Hz and 2800 Hz. For the titanium alloy striking plate 12, the natural frequency is below 5900 Hz, and in a more preferred embodiment the natural frequency is between 5900 Hz and 2800 Hz. For the stainless steel striking plate 12, the natural frequency is below 5400 Hz, and in a more preferred embodiment the natural frequency is between 5400 Hz and 2800 Hz. For the maraging steel striking plate 12, the natural frequency is below 6000 Hz, and in a more preferred embodiment the natural frequency is between 6000 Hz and 2800 Hz. For the amorphous alloy striking plate 12, the natural frequency is below 5500 Hz, and in a more preferred embodiment the natural frequency is between 5500 Hz and 2800 Hz.

TABLE 2

Calculated Striking Plate Properties for a Hybrid Oversized Driver Golf Club Head without scorelines (a = 1.65, b = .875, $\alpha$ = .530, F* = 2500 lb, $r_o$ = 0.5, P = 0.664, $\lambda$ = .154, $\beta$ = 0.25).

| Material (i) | E $10^6$ lb/in$^2$ | v | $\sigma_{yield}$ $10^3$ lb/in$^2$ | $\rho$ lb/in$^3$ | R | T Inch | W lb | S $10^{-5}$ in/lb | $\Delta$ inch | $\omega$ inch | D $10^{-5}$ in/lb |
|---|---|---|---|---|---|---|---|---|---|---|---|
| Stainless Steel(17-4) | 29.0 | .27 | 150 | .276 | 1.67 | .130 | .162 | .803 | .020 | 5458 | .809 |
| Aluminum (7075-T6) | 10.4 | .33 | 73 | .101 | 1.85 | .200 | .092 | .605 | .015 | 8520 | .586 |
| Titanium (Ti 6-4) | 16.0 | .31 | 138 | .160 | 1.79 | .142 | .103 | 1.10 | .027 | 5926 | 1.08 |
| Maraging 280 Steel | 26.5 | .31 | 262 | .285 | 1.79 | .103 | .134 | 1.74 | .043 | 4143 | 1.71 |
| Amorphous Alloy | 13.3 | .30 | 260 | .220 | 1.76 | .102 | .102 | 3.55 | .089 | 3301 | 3.51 |

Although the above description is for wood-type golf club heads having an elliptical face section, the present invention is not limited to such an embodiment. Also included within the bounds of the present invention are iron type golf club heads and golf club heads with $\alpha$ values approaching 1.0.

The golf club head 10 is a fairway wood or a driver. The golf club head 10 has a body 26, excluding the striking plate 12, that is preferably composed of a metal material such as titanium, titanium alloy, stainless steel, or the like, and is most preferably composed of a forged titanium material. However, the body 26, or a portion of the body 26, may be composed of a graphite composite material or the like. The body 26 preferably has a large volume, most preferably greater than 300 cubic centimeters, more preferably 300 cubic centimeters to 450 cubic centimeters, even more preferably 350 cubic centimeters to 400 cubic centimeters, and is most preferably 385 cubic centimeters for a body composed of titanium, or titanium alloy. However, a body 26 composed of stainless steel may have a volume range of 200 cubic centimeters to 325 cubic centimeters, and a body 26 composed of a composite material (such as plies of continuous carbon fiber pre-preg material) may have a volume of 325 cubic centimeters to 600 cubic centimeters. The body 26 preferably weighs no more than 215 grams, and most preferably weighs between 180 and 205 grams. The body 26 has a hollow interior.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims. preferably composed of a forged titanium material. However, the body 26, or a portion of the body 26, may be composed of a graphite composite material or the like. The body 26 preferably has a large volume, most preferably greater than 300 cubic centimeters, more preferably 300 cubic centimeters to 450 cubic centimeters, even more preferably 350 cubic centimeters to 400 cubic centimeters, and is most preferably 385 cubic centimeters for a body composed of titanium, or titanium alloy. However, a body 26 composed of stainless steel may have a volume range of 200 cubic centimeters to 325 cubic centimeters, and a body 26 composed of a composite material (such as plies of continuous carbon fiber pre-preg material) may have a volume of 325 cubic centimeters to 600 cubic centimeters. The body 26 preferably weighs no more than 215 grams, and most preferably weighs between 180 and 205 grams. The body 26 has a hollow interior.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A wood-type golf club head comprising:

a body having a top region, a bottom region, a rear region and an open front;

a striking plate disposed in the open front of the body, the striking plate composed of a titanium alloy material and having a thickness less than 0.200 inch and greater than 0.070 inch, the striking plate having a natural frequency of less than 4500 Hz and greater than 2800 Hz.

2. The wood-type golf club head according to claim 1 wherein the natural frequency is less than 3300 Hz and greater than 2800 Hz.

3. The wood-type golf club head according to claim 1 wherein the natural frequency is less than 3300 Hz and greater than 2800 Hz.

4. The wood-type golf club head according to claim 1 wherein the natural frequency is less than 3300 Hz and greater than 2800 Hz.

5. A wood-type golf club head comprising:

a body having a top region, a bottom region, a rear region and an open front;

a striking plate disposed in the open front of the body, the striking plate composed of a titanium alloy material and having a thickness less than 0.140 inch, the striking plate having a natural frequency of less than 8500 Hz and greater than 2800 Hz.

6. A wood-type golf club head comprising:

a body having a striking plate, the striking plate composed of a titanium alloy material and having a thickness less than 0.200 inch and greater than 0.070 inch, the striking plate having a natural frequency of less than 4000 Hz and greater than 2800 Hz.

7. A wood-type golf club head comprising:

a body having a top region, a bottom region, a rear region and an open front, the body composed of a non-metallic material;

a striking plate disposed in the open front of the body, the striking plate composed of a titanium alloy material and having a thickness less than 0.140 inch, the striking plate having a natural frequency of less than 8500 Hz and greater than 2800 Hz.

* * * * *